United States Patent [19]

Sawyer

[11] 3,942,581

[45] Mar. 9, 1976

[54] METHOD AND APPARATUS FOR CASTING DIRECTIONALLY SOLIDIFIED ARTICLES

[75] Inventor: Thomas F. Sawyer, Ballston Lake, N.Y.

[73] Assignee: General Electric Company, Schenectady, N.Y.

[22] Filed: Nov. 29, 1974

[21] Appl. No.: 527,945

[52] U.S. Cl. ..... 164/60; 164/125; 164/136; 164/348

[51] Int. Cl.[2] ..... B22D 25/06

[58] Field of Search ..... 164/60, 125, 126, 127, 164/136, 338, 348

[56] References Cited

UNITED STATES PATENTS

| | | | |
|---|---|---|---|
| 3,248,764 | 5/1966 | Chandley | 164/127 |
| 3,532,155 | 10/1970 | Kane et al. | 164/60 |
| 3,793,012 | 2/1974 | Walter et al. | 75/171 |
| 3,793,013 | 2/1974 | Walter et al. | 75/171 |
| 3,847,203 | 11/1974 | Northwood | 164/60 |

*Primary Examiner*—Francis S. Husar
*Assistant Examiner*—John E. Roethel
*Attorney, Agent, or Firm*—F. Wesley Turner; Joseph T. Cohen; Jerome C. Squillaro

[57] ABSTRACT

The invention relates to an improved method of casting superalloy articles and more particularly to an apparatus for directionally solidifying eutectic superalloy compositions to produce a composite structure of a superalloy matrix reinforced with aligned carbide fibers. The improvement includes positioning a movable bed of a ceramic insulation around the mold such that as the mold is lowered the bed forms a continuous heat insulating barrier around the sides of the mold to prevent lateral heat transfer.

10 Claims, 2 Drawing Figures

METHOD AND APPARATUS FOR CASTING DIRECTIONALLY SOLIDIFIED ARTICLES

Figure 1:
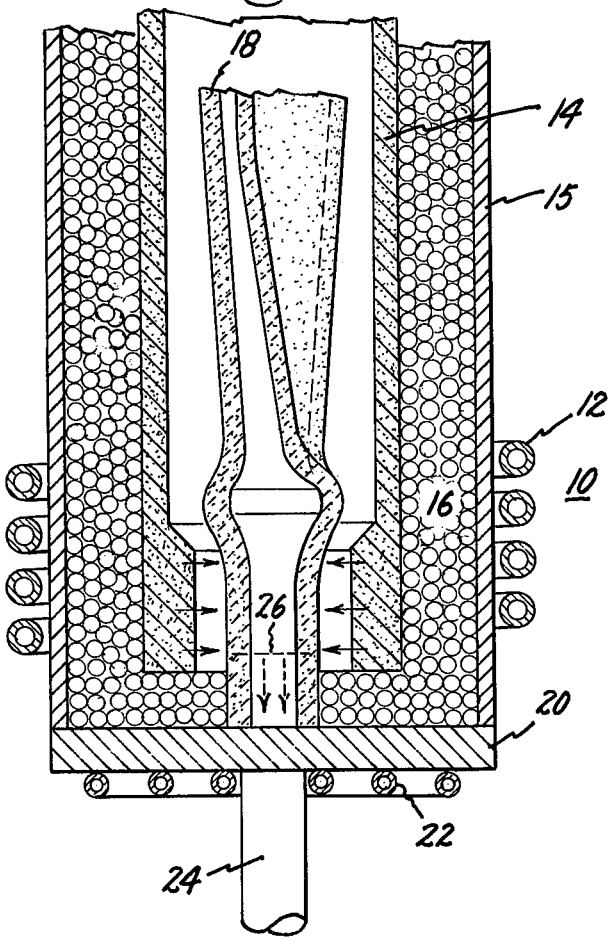

Superalloys are heat resistant materials having superior strength and oxidation resistance at high temperatures. Many of these alloys contain iron, nickel or cobalt alone or in combination as the principal element, together with chromium to impart surface stability and usually containing only one or more minor constituents such as molybdenum, tungsten, columbium, titanium and aluminum for the purpose of effecting strengthening. The physical properties of the superalloys make them particularly useful in the manufacture of gas turbine components.

The strength of superalloys is determined in part by their grain size. At low temperatures fine grained equiaxed structures are preferred. At high temperatures large-grained size structures are usually found to be stronger than fine-grained. This is believed related to the fact that failure generally originates at grained boundaries oriented perpendicular to the direction of the induced stress. An improved technique for casting superalloys used in gas turbine engines was developed by Ver Snyder, U.S. Pat. No. 3,260,505 which discloses the preparation of a blade having an elongated columnar structure with unidirectional crystals aligned substantially parallel to the long axis of the blade. This procedure involves directional solidification whereby almost a complete elimination of grained boundaries normal to the primary stress axis occurs. A further advance was made by Piearcy, U.S. Pat. No. 3,494,709 wherein grained boundaries in superalloys were eliminated by making single crystal castings.

Directional solidification to produce columnar casting and the apparatus used for this purpose are described in *The Superalloys*, Edited by C. T. Sims et al., John Wiley & Sons, (1972), Pages 479–508. Columnar grains are formed when the melt temperature is greater than the freezing temperature and when the flow of heat is unidirectional from the liquid through the solid. Typically, a ceramic investment casting mold is attached to a water-cooled copper chill plate and placed in an induction-heated graphite susceptor. The mold is heated above the melting point of the alloy being cast and the superheated melt is poured into the mold. Heat enters the upper portion of the mold by radiation from the susceptor and is removed through the solidified metal by the chill at the bottom. Thus, solidification occurs in an upward direction through the casting and the rate of solidification is a function of the amount of heat entering at the top of the casting and the amount of heat extracted from the casting through the solid.

In the Stockbarger method, the furnace heat-flow configuration requires a sharp temperature difference between the lower and upper furnace portions which is provided by a baffle. The mold is gradually withdrawn through the baffle so that the solid—liquid interface remains essentially parallel with the plane of the baffle. The Bridgman-type apparatus has been used to produce acceptable elongated grain structures of numerous superalloys. Here the susceptor is heated inductively, which melts the charge in the crucible. After equilibrium is established, the mold assembly is lowered out of the heat zone and nucleation of solid occurs in the bottom of the crucible. Directional freezing continues upward as the mold unit is lowered.

Walter et al, U.S. Pat. No. 3,793,012 discloses the preparation of unidirectionally solidified nickel-base carbide reinforced cast superalloy bodies having high strength and high stress-rupture properties, particularly at elevated temperatures. The reinforced fibers present in the matrix were aligned single crystal fibers of metal monocarbides. When such castings are made in shell molds as in the manufacture of turbine buckets, the outer configuration of the shell is not symmetrical due to projections of the platform and dovetail sections, as well as the thinning and twisting of the shell to conform to the pattern of the airfoil section of the bucket. Attempts to directionally solidify a bucket using such an irregular shaped shell have proven very difficult due to the gap between the radiation baffle and the shell, to allow clearance of the shell as it is being withdrawn from the heat zone.

In accordance with the present invention, I have discovered an improved apparatus for producing a directionally solidified article from a eutectic superalloy composition. The apparatus comprises a mold within a heating zone in which the bottom of the mold is attached to a chill plate; a retaining means for a ceramic insulation around the heating zone and the lower portion of the mold, the retaining means being attached at its bottom to the chill plate; a hollow ceramic insulation disposed in the retaining means and in contact with the lower portion of the mold; and a means for lowering the mold out of the heating zone and to permit the insulation to form a continuous heat barrier around the portion of the mold descending out of the heating zone. My invention further includes the method of using the apparatus to directionally solidify nickel -or cobalt-base superalloys by disposing a plurality of hollow ceramic bodies around the mold such that as the mold is lowered, the bodies conform to and form a contacting layer around the outside surface of the mold as it is exposed below the heating zone whereby lateral heat transfer is prevented.

Figure 2:
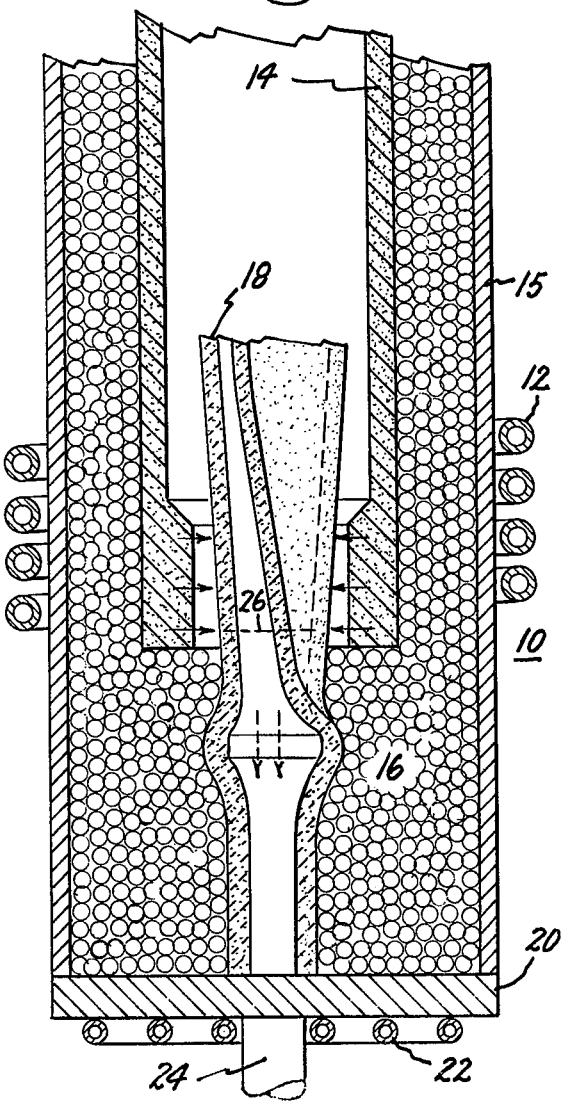

The invention is more clearly understood from the following description taken in conjunction with the accompanying drawing in which:

FIG. 1 is a cross-sectional view of the apparatus of my invention during an early stage of directional solidification; and FIG. 2 is a cross-sectional view of the apparatus of FIG. 1, during a later stage of the process.

Referring now to the drawing, in FIG. 1 the furnace 10 conventionally used for directional solidification is heated from outside by induction heating coil 12. Within the furnace 10 is a susceptor 14 comprised of graphite or a similar material. An insulation retainer means 15, such as a jacket, is positioned around the susceptor and mounted to a chill plate 20 which is water-cooled at its bottom through channels located at 22. disposed within the susceptor is a shell mold 18 which in this instance is shaped to produce a gas turbine blade. The top portion of the mold 18 is provided with an opening into which molten alloy may be poured, while the bottom portion of the mold 18 is attached to the chill plate 20. A lowering means 24, a portion of which is illustrated, is mounted to permit vertical movement with respect to the furnace 10.

The space between the retaining means 15, the shell mold 18, and the chill plate 20 is occupied by a hollow ceramic insulation 16 which lies against the shell mold 18 to provide no radiation heat path from the hot susceptor 14 to the solidified area below the solid—liquid interface 26 arising during directional solidification. The insulation 16 is preferably in the form of hollow spherical bubbles which are formed from a high temperature ceramic such as alumina or zirconia. A representative material is commercially available as Norton ALUNDUM E-163 fused alumina grain. This is a high purity, greyish-white, bubble-type insulating alumina grain having a melting temperature of about 2000°C. The packing density varies from 50–65 pounds per cubic foot.

In FIG. 2 wherein like parts are designated by the same numbers, a view is shown during a later stage of directional solidification as compared to FIG. 1. Since the hollow spherical insulation 16 is loosely filled in the prescribed space, the insulation is permitted to flow as the directional solidification step progresses. Thus, the insulation forms a natural self-adjusting radiation baffle regardless of the shape of the shell mold 18 or its position during the solidification process. The arrows shown in both figures are used to illustrate the heat flow from the furnace 10 to the chill plate 20.

Using the apparatus and method of the present invention, unidirectionally solidified nickel-base carbide reinforced cast superalloy bodies have been prepared as disclosed by Walter et al, U.S. Pat. No. 3,793,012. The reinforced fibers present in the matrix were aligned single crystal fibers of metal monocarbides. The range of compositions of the unidirectionally solidified castings in weight percent was reported to be about 6.5–10.0% chromium, 14–23% tantalum, 0.5–1.5% carbon, up to 6.0% aluminum, up to 1.0% titanium, up to 8.5% cobalt, up to 5.0% molybdenum, and the balance essentially nickel. A preferred composition, designated as TaC-1900 had high strength and high stress-rupture properties. The nickel-base superalloy can also be modified as disclosed by Walter, U.S. patent application Ser. No. 482,589, filed June 24, 1974, and having the same assignee as the instant application, to include by weight at least 2.0% rhenium, and at least 6.0% tungsten, but containing less than 5.0% aluminum and less than 7.0% chromium and an aligned reinforced fibrous phase of tantalum monocarbide embedded in the matrix.

Other alloys which can be employed in my process are cobalt-base tantalum carbide eutectic alloys as disclosed by Walter et al, U.S. Pat. 3,793,013 and having a composition in weight percent of up to 26.0% chromium, 13.5–19.0% tantalum, up to 10.0% nickel, up to 6.5% tungsten, up to 1.0% iron, 1.2–1.5% carbon and the balance essentially cobalt.

It will be appreciated that the invention is not limited to the specific details shown in the illustrations and that modifications may be made within the ordinary skill in the art without departing from the spirit and scope of the invention.

I claim:

1. An apparatus for producing a directionally solidified article from a eutectic superalloy composition comprising:

a. a mold within a heating zone, said mold having a lower portion and being attached at its bottom to a chill plate;

b. a retaining means for a ceramic insulation around the heating zone and said lower portion of the mold, said retaining means being attached at its bottom to said chill plate;

c. a substantially spherical ceramic insulation disposed in said retaining means and in contact with said lower portion of the mold; and d. a means for lowering said mold out of said heating zone and to permit the insulation to form a continuous heat barrier around the portion of the mold descending out of the heating zone.

2. The apparatus of claim 1, wherein said insulation is a plurality of hollow alumina bodies.

3. The apparatus of claim 1, wherein said insulation is a plurality of hollow zirconia bodies.

4. In the casting of superalloys wherein molten alloy is introduced into a movable mold extending into a heating zone and gradually lowering the mold and simultaneously chilling the lower end of the mold to achieve directional solidification, the improvement comprising disposing a plurality of hollow ceramic bodies around the mold such that as the mold is lowered, the bodies conform to and form a contacting insulating layer around the outside surface of the mold as it is exposed below the heating zone whereby lateral heat transfer is prevented.

5. The method of claim 4, wherein the superalloy is a eutectic composition and the directionally solidified product has a composite structure of a superalloy matrix reinforced with aligned carbide fibers.

6. The method of claim 4, wherein said superalloy is a nickel-base alloy.

7. The method of claim 6, wherein said superalloy contains tantalum and carbon in an amount sufficient to form tantalum monocarbide fibers during directional solidification.

8. The method of claim 4, wherein said superalloy is a cobalt-base alloy.

9. The method of claim 8, wherein said superalloy contains tantalum and carbon in an amount sufficient to form tantalum monocarbide fibers during directional solidification.

10. The method of claim 4, wherein said hollow ceramic bodies have a composition selected from the group consisting of alumina and zirconia.

* * * * *